US007607538B2

(12) United States Patent
Silvenis et al.

(10) Patent No.: US 7,607,538 B2
(45) Date of Patent: Oct. 27, 2009

(54) CONTAINER FOR TRANSPORTING A BLISTER PACKAGE

(75) Inventors: Scott A. Silvenis, Cleveland, TN (US); Richard S. Costa, Bedminster, NJ (US); Hung D. Mach, Fort Lee, NJ (US)

(73) Assignee: Schering-Plough Healthcare Products, Inc., Memphis, TN (US)

( * ) Notice: Subject to any disclaimer, the term of this patent is extended or adjusted under 35 U.S.C. 154(b) by 1 day.

(21) Appl. No.: 11/845,570

(22) Filed: Aug. 27, 2007

(65) Prior Publication Data

US 2009/0057189 A1 Mar. 5, 2009

(51) Int. Cl.
*B65D 83/04* (2006.01)

(52) U.S. Cl. ..... 206/530; 206/528; 206/538

(58) Field of Classification Search ..... 206/528, 206/529, 530, 531, 532, 534.2, 533, 538, 206/764, 534, 539, 477
See application file for complete search history.

(56) References Cited

U.S. PATENT DOCUMENTS

| | | | | | |
|---|---|---|---|---|---|
| 4,120,400 | A * | 10/1978 | Kotyuk | 206/528 |
| 4,165,709 | A * | 8/1979 | Studer | 116/308 |
| 4,192,422 | A * | 3/1980 | Kotyuk | 206/528 |
| 4,660,991 | A * | 4/1987 | Simon | 368/10 |
| 4,817,819 | A | 4/1989 | Kelly | |
| 5,878,887 | A * | 3/1999 | Parker et al. | 206/528 |
| 6,021,901 | A | 2/2000 | Wolfe | |
| 6,082,544 | A * | 7/2000 | Romick | 206/531 |
| 6,349,831 | B1 | 2/2002 | Buss | |
| 6,523,691 | B2 * | 2/2003 | Raj et al. | 206/538 |
| 7,208,176 | B2 * | 4/2007 | Faour et al. | 424/468 |
| 7,419,056 | B2 * | 9/2008 | Gattefosse et al. | 206/531 |
| 2004/0256277 | A1 * | 12/2004 | Gedanke | 206/538 |
| 2005/0183981 | A1 | 8/2005 | Gelardi | |
| 2007/0235349 | A1 * | 10/2007 | Nichols et al. | 206/37 |
| 2007/0272585 | A1 * | 11/2007 | Fabricius et al. | 206/532 |

FOREIGN PATENT DOCUMENTS

| | | | |
|---|---|---|---|
| DE | 10 2007 015 090 | A1 | 10/2008 |
| EP | 1 736 133 | B1 | 7/2008 |
| WO | WO 2007/082543 | A1 | 7/2007 |

OTHER PUBLICATIONS

International Search Report (PCT/US2008/010098) for OT06712, mail date Jan. 15, 2009, 4 pages.

* cited by examiner

*Primary Examiner*—Luan K Bui
*Assistant Examiner*—Chun Cheung
(74) *Attorney, Agent, or Firm*—Matthew J. Golden

(57) ABSTRACT

A container for transporting a blister package is disclosed. The container may include a cover, a base, and a flanged element, the container being adapt to slidably accept a blister package between the base and the flanged element. The base may include a guide member that supports the underside of the blister package. The flanged element may laterally support the blister package by contacting the walls of the blisters of the blister package.

6 Claims, 6 Drawing Sheets

SECTION A–A

CONTAINER FOR TRANSPORTING A BLISTER PACKAGE

BACKGROUND

Many over-the-counter and prescription medications are packaged in blister packages having a backing attached to a planar portion and a blister portion raised from the planar portion and typically containing at least one pill, whereby a consumer dispenses the medication through the backing by pressing and deforming the raised blister. These packages are typically sold as a box containing at least one matrix with individual blisters sometimes separable by perforations.

Many medications, such as allergy medications, need to be taken periodically throughout the day. For active individuals, this presents a problem with the transport of the aforementioned blister packages. It is impractical to carry the entire box, as typically only a small number of doses are needed throughout the day. The user could tear off, via the perforations, the amount of pills needed and carry just that amount. Problems arise, however, when these blister packages are transported, for example, in a purse or a pocket. When the blister units are separated from the matrix via the perforations, sharp corners, rough and/or uneven edges often results that can cause snags with cloth or other items and potentially injure the user. Some pills are also subject to damage due to rough handling; this is particularly a problem for agents which are perceived to have a bad taste, which would otherwise have their flavors masked by a coating and which would be easily swallowed. Accidental dispensing of the medication can occur if the blister is accidentally pressed due to pressure or interaction with other items. Even if the medication is not dispensed, the typically thin backing can be punctured or partially separated, allowing contamination of the medication.

DETAILED DESCRIPTION OF EXAMPLE EMBODIMENTS

Figure 1A:
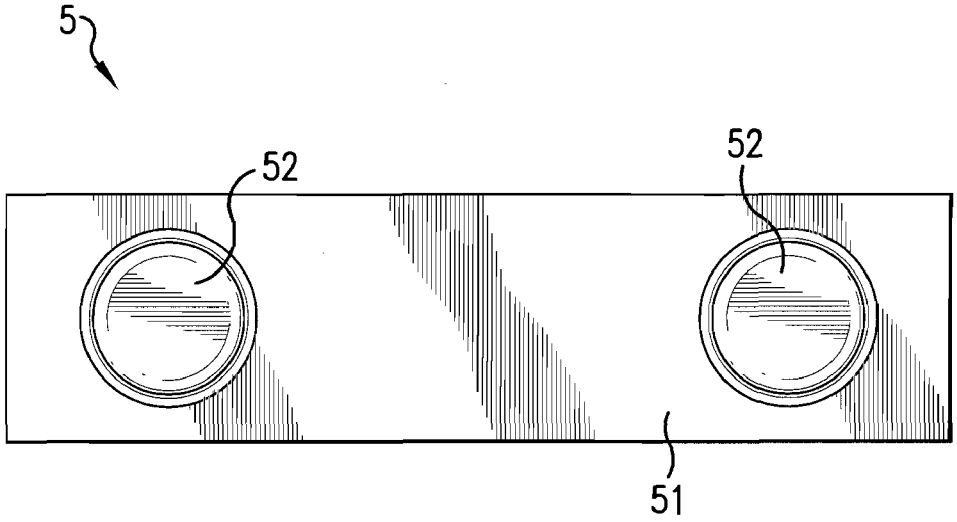
FIGS. 1A and 1B depict a typical blister package.

Some example embodiments of the present invention are designed to provide a blister package container that is portable, easy to use on the go, and avoids the aforementioned problems associated with the transport of blister packages. Some of these example embodiments may include a cover, a base, and a flanged element. Some of these example embodiments may be capable of slidably accepting a blister package between the base and the flanged element. Some of these example embodiments may include a base having a guide member that supports the underside of the blister package. Further, some of these example embodiments may have a fanged element that laterally supports the blister package by contacting the walls of the blisters of the blister package.

Some example containers, according to some example embodiments of the present invention are containers including a base with an interior surface, multiple longitudinal ribs on the interior surface that are sloped toward and contact a first region of a periphery of the base, at least one of which having a non-sloped portion that substantially spans the length of the interior surface toward a second region of the periphery, and a latching element. The example containers may also include a cover attached to the base by a hinge and having a second latching element that is latchably engageable with the first latching element when the cover is in a closed position. The example containers may further include a U-shaped flanged element attached to the base via post connectors and situated between the base and the cover when the cover is in the closed position.

Some example containers, according to some example embodiments of the present invention, have a base with an interior surface, a closeable cover that forms a closed cavity with the base when closed, a flanged element attached to the base and situated between the base and the cover when the cover is closed, and at least one guide member located on the interior surface of the base. In some examples, the container may slidably receive a blister package between the guide member or members and the flanged element. In some examples, the container may have a flanged element that covers only a non-blister portion of a top surface of a blister package when the blister package is situated between the base and the flanged element, where the top surface of the blister package has a blister and the bottom surface of the blister package has a backing. In some examples, the containers may also have a flanged element that slidingly contacts at least one portion of a blister package when the blister package is inserted in the container. In some examples, the container may also have a base that is attached to a cover by a hinge. In some examples, the container is injection-molded. In some examples, the container may also have a base, at least one guide member, and a cover that are all integrally molded as a single piece. In some examples, the container may also have a latch that may secure a cover to a base in when the cover is in a closed position. In some examples, the container may have a flanged element with two substantially parallel extensions that may receive at least one blister of a blister package therebetween when the blister package is inserted. In some examples, the container may farther have a flanged element that is continuous and U-shaped. In some examples, the container may have at least one guide member that supports the underside of a blister package along its length by the underside in a region between two substantially parallel extensions of a flanged element when the blister package is inserted In some examples, the container may have at least one guide member that is a rib. In some examples, the container may have a cover that forms a first positive stop to prevent the blister package, when inserted, from sliding in a first direction along an axis when the cover is in the closed position. In some examples, the container may further have at least one of a base, at least one Wide member, and a flanged element that forms a second positive stop for preventing the blister package, when inserted, from sliding in a second direction along the axis. In some examples, the containers may be dimensioned such that the distance between inwardly facing surfaces of two substantially parallel extensions of the flanged element is slightly larger than the diameter of blister portions of a blister package. In some examples, the container may also have at least one guide member with an upwardly sloped portion at least one end thereof. In some examples, the container may have a flanged element that is attached to the base by a plurality of post connectors. In some examples, the container may have post connectors that are each made up of a male post on one of the base and the flanged element and a female post on the other of the base and the flanged element. Some example containers contain a pharmaceutical compound, e.g., an antihistamine such as, e.g., loratadine, in solid dosage form that is contained in a blister package, the blister package situated between the base and flanged element.

Some example containers, according to some example embodiments of the present invention, have a base with a cavity to hold a blister package and a removable flange inserted into the base and situated between the base and a cover to retain the blister package in the cavity.

Some example containers, according to some example embodiments of the present invention, include a base, a cover, and a flanged element. This example arrangement allows blister packages to slide and be guided into the container between the base and the flanged element along a sliding axis. This arrangement may be beneficial because it maintains the blister package in a relatively secure position while the cover is being opened and closed. Without the sliding insertion and blister guides, the user would have to take greater care in positioning the blister package within the container as the cover is closed and in preventing the blister package from falling out of the container as the container is opened. Some example embodiments have a hinge connecting the cover to the base. This may be beneficial to provide ease of operation and to prevent loss of the cover. Some example embodiments have a latch to secure the container in the close position.

Some example containers, according to some example embodiments of the present invention, include a flanged element that may slidingly communicate with the sides of the raised blister portion of the blister package. The raised blister portions typically present a plastic surface that is relatively smooth, even after the deformation resulting from dispensing of the medication therefrom. By laterally supporting the blister packages at the sides of the blister portions, significantly smoother insertion and removal of the blister packages from the container is possible. This is in contrast to laterally supporting the blister package along the edges of the planar surface, which have been found to be rough and/or uneven due, for example, to tearing via the perforations of the blister package matrix This irregular surface hinders sliding and could cause the blister package to snag or catch within the container, potentially preventing insertion and or removal of the blister package. In some example embodiments, the flanged element has two substantially parallel extensions that allow a blister of the blister package to travel therebetween. In some example embodiments, the flanged element is U-shaped. A U-shape would allow the flanged element to be formed as a single piece while having two oppositely oriented flanges. This may be employed to reduce manufacturing and/or assembly costs.

Some example containers, according to some example embodiments of the present invention, may include at least one guide member disposed on the base. This guide member may facilitate the sliding interface with the blister package. For example, it may be beneficial to minimize the sliding friction between the base and the blister package. Moreover, it may be beneficial to minimize the area of contact between the base and the blister package. This may reduce the potential for damage to the blister package backing and would further facilitate the insertion of a blister package having at least one dispensed unit (i.e., a punctured blister). In some example embodiments, the guide member is a longitudinal rib, which allows a smooth, supportive surface with a small amount of contact area and friction with the blister package. In some example embodiments, at least one rib may substantially span the area that receives the blister package. Some example embodiments may have a plurality of parallel ribs.

Some example containers, according to some example embodiments of the present invention, have a base with a raised peripheral rim. This may be employed to provide structural rigidity to the base member and will mask tolerance differences between the base and cover as well as other imperfections. Some example embodiments may also have a cover with a raised peripheral rim. This may be employed to provide structural rigidity to the cover. Further, some example embodiments may have a cover with a raised rim that communicates with a raised rim of the base. This may be employed to provide a closed space that prevents foreign matter, such as dirt, from being introduced to the container in the closed position. Some example embodiments may also have a first latching element disposed on the rim of the base and a second latching element disposed on the rim of the cover, wherein the first and second latching elements communicate to form a latch.

Some example containers, according to some example embodiments of the present invention, may have a base that has a leftmost end and a rightmost end and includes at least one guide member that is upwardly sloped at least one of the leftmost end and the rightmost end. This sloped guide member may be employed to slightly inhibit the blister package from sliding out of at least one end of the container. This may be beneficial to prevent accidental slippage of the blister package out of the container when the container is being opened or closed. Further, according to some example embodiments, the raised portion of the slope corresponds to a height of a peripheral rim of the base. This may be employed to allow the bottom of the blister package to sit at a location below the rim and still allow a leading edge to clear the rim as the blister package is removed from the container. This may be beneficial to allow a more compact container design.

Some example containers, according to some example embodiments of the present invention, may be injection molded. This may be employed to provide a low cost container.

Some example containers, according to some example embodiments of the present invention, may have a flanged element that is manufactured separate from the base and is attached to the base. This may allow simpler and less costly manufacturing processes such as injection molding. Some example embodiments have a base that is formed in one piece with the cover along with a hinged portion therebetween. This may allow the container to be manufactured using as few pieces as possible. For example, an example container may be injection molded from two pieces, the first piece including the base, hinge, and cover, and the second piece including the flanged element. This may be employed to ease assembly and lower manufacturing costs.

Some example containers, according to some example embodiments of the present invention, may have a fanged element that is attached to the base by a plurality of post members. Each post member may have a male post member on one of the base and the flanged element, and a female post member on the other of the base and the flanged element, wherein the base and the flanged element are joined by inserting the male post into the female post. These post members may eliminate the need for adhesives. This may be employed to achieve a low cost assembly method. In some example embodiments, however, the post members may be joined using adhesive. Some example embodiments may have four spaced apart post members. This arrangement allows a sturdy construction in conjunction with low manufacturing and assembly costs.

Some example containers, according to some example embodiments of the present invention, may have a cover that functions as a first positive stop, preventing the blister packaged from sliding in at least one direction along a sliding axis when the cover is in the closed position. Some example embodiments may have at least one of a base, a guide member, and a flanged element that functions as a second positive stop, preventing the blister pack from moving in one direction along a sliding axis when the blister package is inserted into the case. This may be employed to simplify insertion of the blister package by eliminating the need to manually position the blister package along the sliding axis before closing the case. The container may have a positive stop at both ends of the container when the container is closed. This arrangement ensures that the blister package does not escape from the container when the container is closed. The positive stops may contact the blister packages at least one of a side wall of the raised blister portion and an edge of the planar portion.

Some example containers, according to some example embodiments of the present invention, may be well-suited to receive blister packages having different sizes. This feature may allow the same container to be used for a variety of different diameters, sizes, and shapes of medications. This feature may be achieved by optimizing the length of the case and the width and spacing apart of the flanges of the flanged element.

Figure 1B:
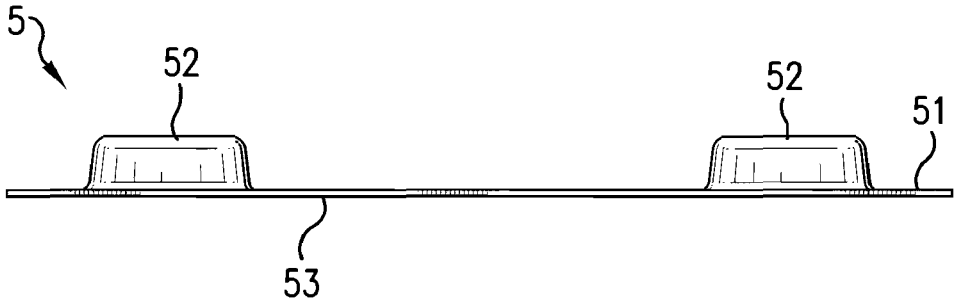

The following describes certain embodiments of the invention depicted in the accompanying figures. For any reference to elements not depicted in a particular figure being described but depicted in another figure(s), the reader is hereby directed to the depiction in the other figure(s). FIGS. 1A and 1B depict a typical blister package 5 The blister package has a raised blister portion 52. The blister portion 52 is typically formed on plastic and integrally formed with a planar portion 51. A medication (not shown), typically in the form of a pill or a tablet, is disposed within the blister portion 52 and retained therein by a backing 53, typically formed from foil films, paper structures, or combinations thereof including laminates, applied to the underside of the planar surface. In a typical arrangement, to dispense the medication, the user applies downward force to the blister portion 52, which deforms in response thereto. As the blister portion 52 is deformed it contacts the medication and causes the medication to press against the backing. As additional force is applied, the medication breaks through the backing, allowing the user access to the medication. Alternatively, in some arrangements, the backing or a portion thereof may be peeled from the blister package to allow the medication to be removed. Typically, blister packages are sold in a box that contains at least one matrix of blister packages, typically separated by perforation lines for tearing units from the matrix. Although FIG. 1 depicts a blister package having two blisters in a single row, it will be appreciated that the example container may be dimensioned to accommodate any number of blisters in any number of rows.

Figure 2:
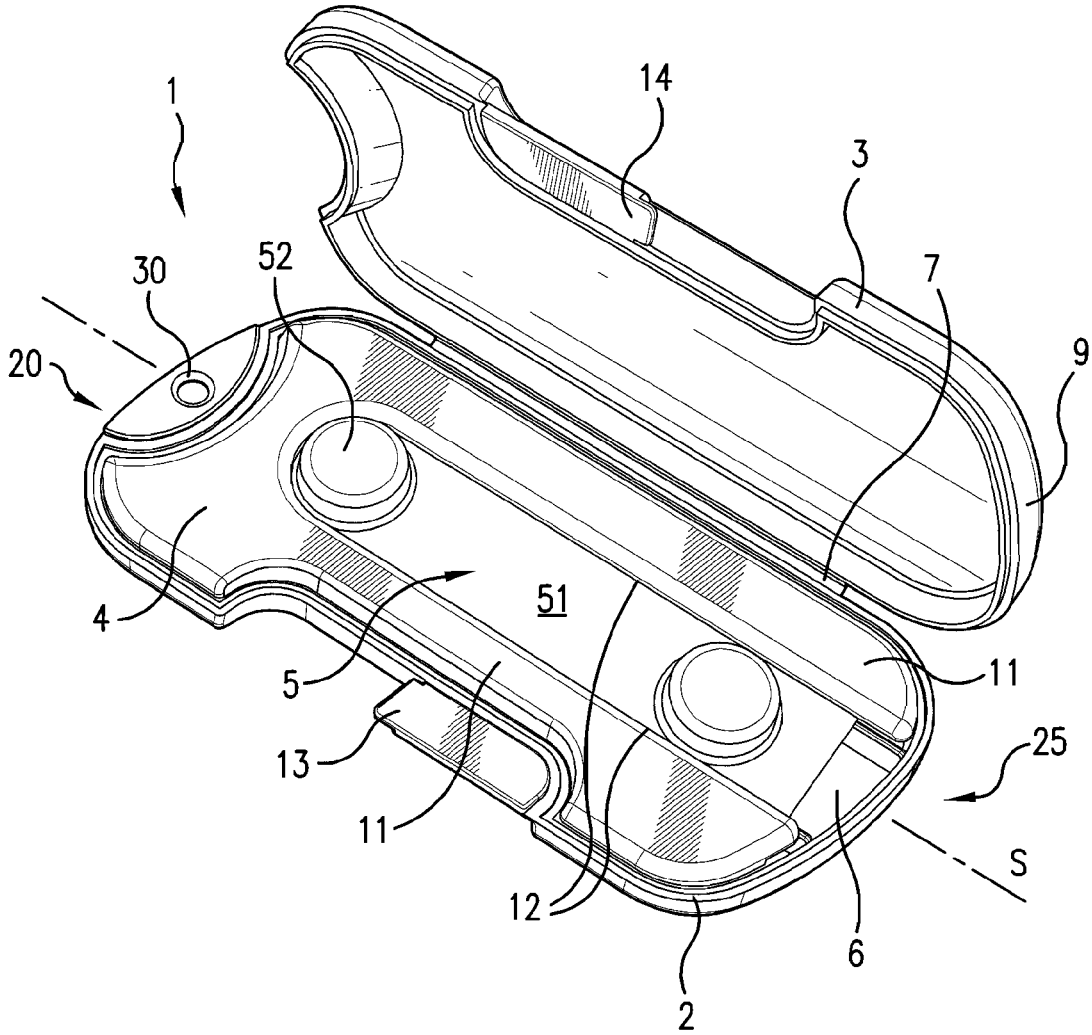
FIG. 2 depicts an isometric top perspective of an example blister package container in an open position and with a blister package in an inserted position, according to an example embodiment of the present invention.

FIG. 2 depicts an isometric top perspective of a blister package container 1 in an open position, according to an example embodiment of the present invention. The container has a base 2, a cover 3 attached to the base 2 at a hinge 7, and a U-shaped flanged element 4 attached to the base 2. FIG. 2 also shows the blister package 5 when inserted into the blister package container 1 along an axis S through opening 6 between the base 2 and flanged element 4. When the blister package container 1 is in the open position, the blister package 5 is inserted by sliding the blister package 5 in a first direction along the axis S. The blister package 5 is removed from the blister package container 1 by sliding the blister package 5 in a second direction along axis S, the second direction being opposite the first direction. It will be appreciated that in other example embodiments, the axis S could be the short axis or any other axis of the blister package container. It will also be appreciated that the cover may be detached from the base or may be attached by alternate mechanisms, such as, e.g., a tether or a sliding relationship between the cover and the base.

The flanged element 4 has two spaced-apart flanges 11 extending parallel to the axis S. It will be appreciated that the U-shaped flange may be sized to accommodate a blister package of particular dimensions or multiple blister packages of varying dimensions. It will also be appreciated that different orientations, e.g., a flange facing along the short axis, or a comb-shaped flange or a wider flange to contain multiple blister package rows, may also be employed. As the blister package 5 is inserted into the blister package container 1, the raised blister portions 52 extend above a lower surface of the flanges 11. The lower surface of the flanges 11 retains the blister package 5 within the blister package container 1 by forming a positive stop with the planar portion 51 of the blister package 5 at locations next to the blister portions 52, thus restraining the blister package along an axis normal to the planar portion 51.

As the blister package 5 is inserted into the blister package container 1, it encounters a positive stop toward a leftmost end 20 of the blister package container, opposite the opening 6. The embodiment of FIG. 2 shows a rounded section of the U-shaped flanged element 4 forming a positive stop with the blister portion 52 of the blister package 5. The blister package container 1 may also form a positive stop with an edge of a planar portion of a blister package if the planar portion extends a sufficient distance between the base 2 and the flanged element 4. In that scenario, the edge of the planar portion would form a positive stop with at least one of the flanged element 4 and the base 2. Although FIG. 2 depicts a blister package container having a single opening toward a rightmost end 25 thereof, it will be appreciated that other example embodiments may have a single opening toward the leftmost end 20 (with a positive stop toward the rightmost end 25), or two openings, one toward each of the leftmost end 20 and the rightmost end 25.

An aperture 30 is provided at one end of the base 2 that may accept a carrying means, such as a chain, strap, or key ring, therethrough. This may facilitate the transport of the container 1.

Figure 3:
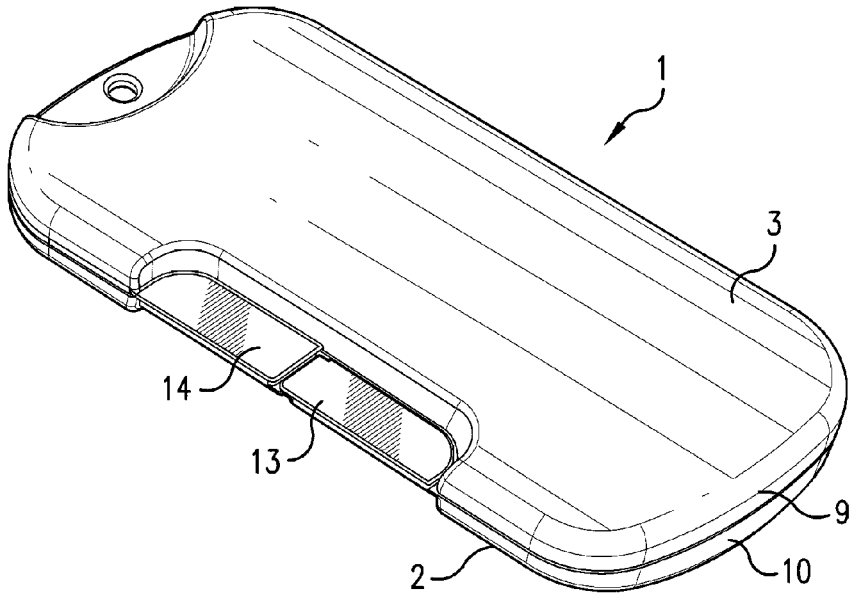
FIG. 3 depicts an isometric top perspective of the example blister package container, according to the example embodiment of the present invention, in a closed position.

FIG. 3 depicts an isometric top perspective view of the blister package container 1 of FIG. 2 in a closed position. In the closed position, a rim 9 of the cover communicates with a rim 10 of the base to form a closed compartment. In the closed position, a portion of the rim 9 prevents removal of the blister package 5 by providing a positive stop with an edge of the planar section 51 of the blister package 5, thereby preventing the blister package 5 from sliding in the second direction along axis S. It will be appreciated, however, that according to other example embodiments (e.g., a blister package container wherein the blister package can be inserted from either the leftmost or the rightmost end thereof), the rim 9 may prevent removal of the of the blister package along both the first direction and the second direction along the axis S. A first latching element 13 disposed on the rim 10 of the base 2 and a second latching element 14 disposed on the rim 9 of the cover 3 communicate when the blister package is in the closed position to form a latch. The latch maintains the closed position via a friction fit. It will be appreciated however, that in other example embodiments, alternative or additional latching features may be employed, such as, e.g., a snap, a strap, a slide, a button, or a magnet.

Figure 4:
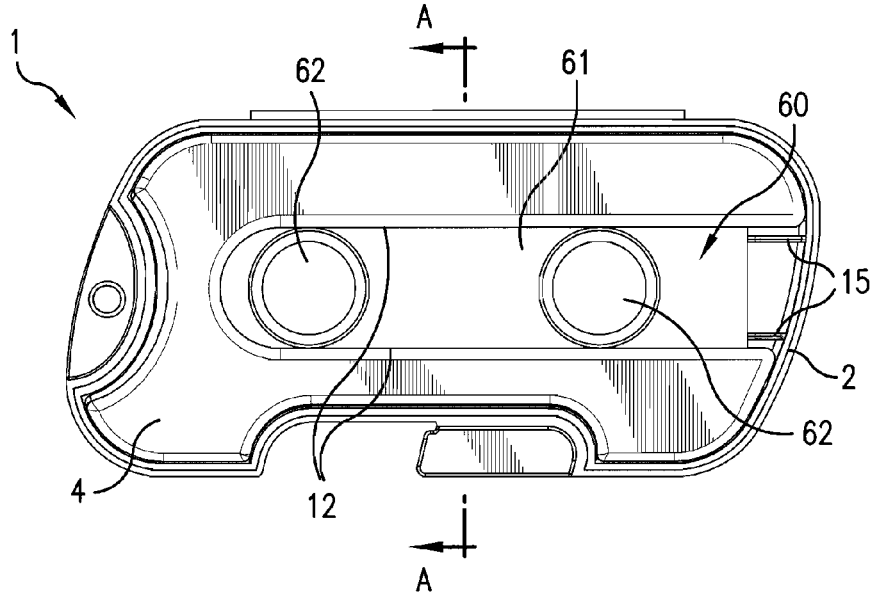
FIG. 4 depicts a top view of the flanged element and base of the example blister package container with a blister package in an inserted position, according to the example embodiment of the present invention.

FIG. 4 depicts a top view of the flanged element 4 and the base 2 of the example blister package container 1 with a blister package 60 in an inserted position, according to the example embodiment of the present invention. The cover 3 is not shown in FIG. 4. The blister package container of FIG. 4 is the same embodiment as the blister package container of FIG. 2, but with a different blister package 60. The blister package 60 has blister portions 62 that are more closely spaced together and have a planar portion 61 that extends farther longitudinally beyond the blister portions 62 with respect to the blister package 5. The dimensions of blister package 60 are such that the leftmost edge of the planar portion 61 encounters a positive stop before the leftmost blister portion 62 contacts the rounded section of the U-shaped flanged element 4, As the blister package 60 is inserted and removed from the blister package container 1, the blister package 60 is guided laterally (with respect to axis S) by sliding contact between the lateral edges of raised blister portions 62 and inwardly facing surfaces 12 of the flanges 11 of the flanged element 4. This form of lateral guidance is effective even when some or all of the blisters have been deformed after dispensing. In this regard, the flanged element may be dimensioned such that the distance between the inwardly facing surfaces 12 is approximately the same size as the blister, but with sufficient clearance to allow the blister to slide therebetween. Moreover, it may be beneficial to limit the distance between the inwardly facing surfaces 12 to the extent necessary to prevent excessive rattling of the blister package within the blister package container. The blister packages may alternatively be guided via the lateral edges of the planar portion. However, these edges can be rough and irregular due to tearing of the blister packages from a blister matrix along perforation lines, which can also result in inconsistent lateral dimensions. This creates the potential for difficult insertion and/or removal. Guiding the blister packages by contacting the blister portions may be beneficial, as the blister portions typically remain smooth and retain consistent outer dimensions, even after being deformed during dispensing of the medication, this regard, it may be beneficial to dimension the flanged element 4 such that the distance between the inwardly facing surfaces 12 is slightly larger than the diameter of the blister portions. This may be beneficial to ensure that the blister portions fit within the container while maintaining adequate lateral support.

By leaving the blister portions 62 exposed when the blister package container 1 is in an open position, the user may slide the blister package into and out of the blister package container 1. In this regard, the user may, for example, use a thumb or index finger to push a blister portion 62 in either direction along the axis S.

Figure 5:
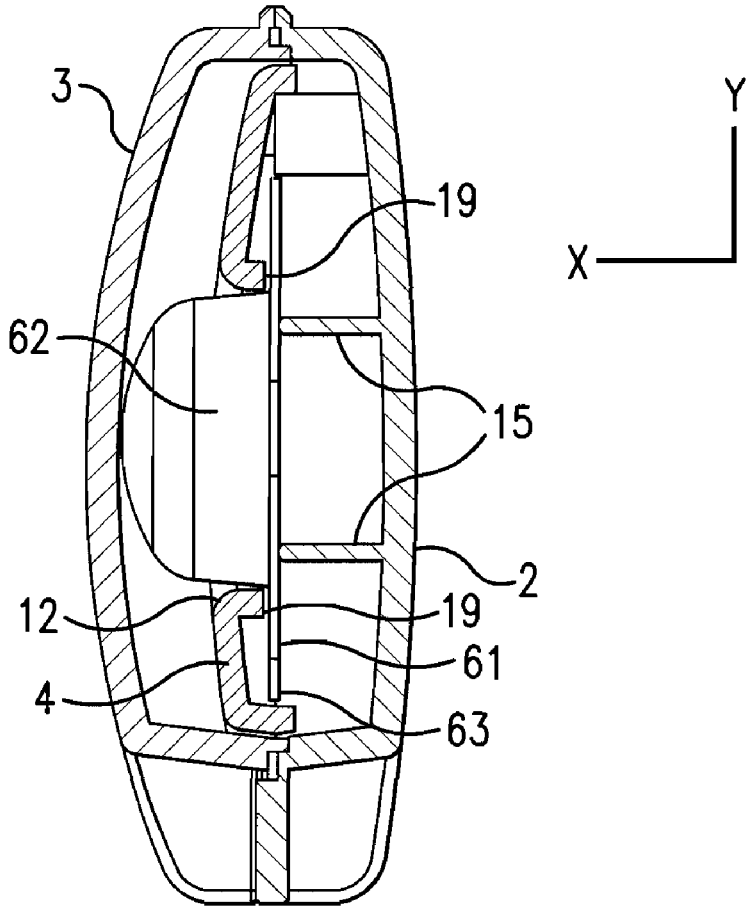
FIG. 5 depicts a cross-sectional view of the example blister package container, according to the example embodiment of the present invention, along line A-A of FIG. 4, with the cover in a closed position.

FIG. 5 depicts a cross-sectional view of the example blister package container 1, along line A-A of FIG. 4, with the cover 3 in a closed position. The base 2 has two parallel longitudinal guide members 15 that support the blister package in a direction along the X-axis by contacting the backing-side of the planar portion 61. It is beneficial that the guide members contact the blister package 60 at a location between the inwardly facing surfaces 12. This prevents accidental dispensing of the medication as the blister package 60 is removed and inserted into the blister package container 1, because the backing 63 is supported at a location beneath the blister portions 62. Lower surface 19 of the flanged element 4 restrains the blister package in the opposite direction along the X-axis by contacting the planar portion 61 at the surface opposite the backing 63. When the container 1 is in the closed position, the cover 3 can provide additional constraint by contacting the top of the blister portions 62. Inwardly-facing surfaces 19 of the flanged element 4 constrain the blister package from movement along the Y-axis by contacting the sidewalls of the blister portions 62. Because each of the guide members 15, the lower surface 19, and the inwardly-facing surfaces 12 contact the blister package with a minimal amount of surface area, sliding friction between the blister package 60 and the blister package container 1 is minimized during insertion and/or removal. The guide members 15 are in the form of continuous ribs. Although many designs are possible, it may be beneficial to have a smooth, continuous shape. This can prevent the guide members from tearing the backing 63 or catching the torn backing if a blister has been depressed. It will be appreciated, however, other guide member configurations may be utilized, such as, e.g., non-linear or non-continuous guide members. It will also be appreciated that any number of guide members may be used. The guide members 15 also provide added rigidity to the base 2.

Figure 6A:
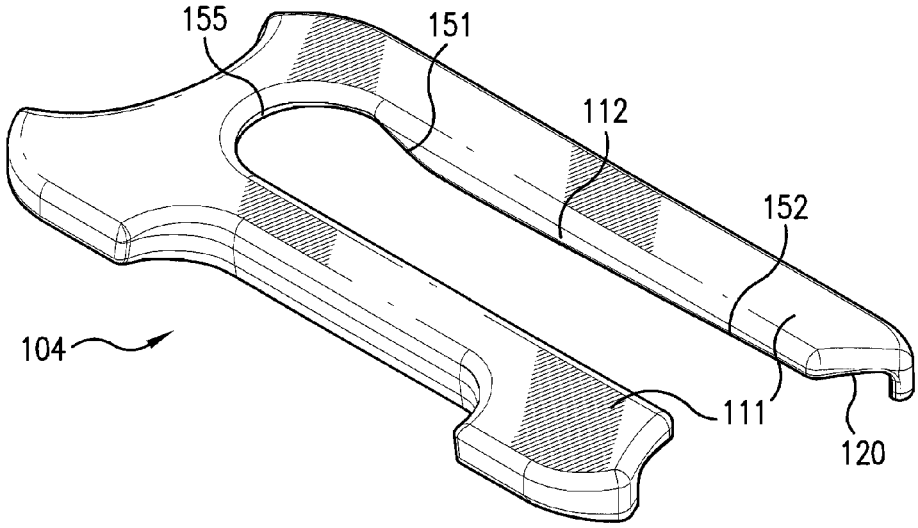
FIGS. 6(*a*) and 6(*b*) depict an isometric top perspective view of the components of a second example blister package container according to an alternative example embodiment of the present invention.
Figure 6B:
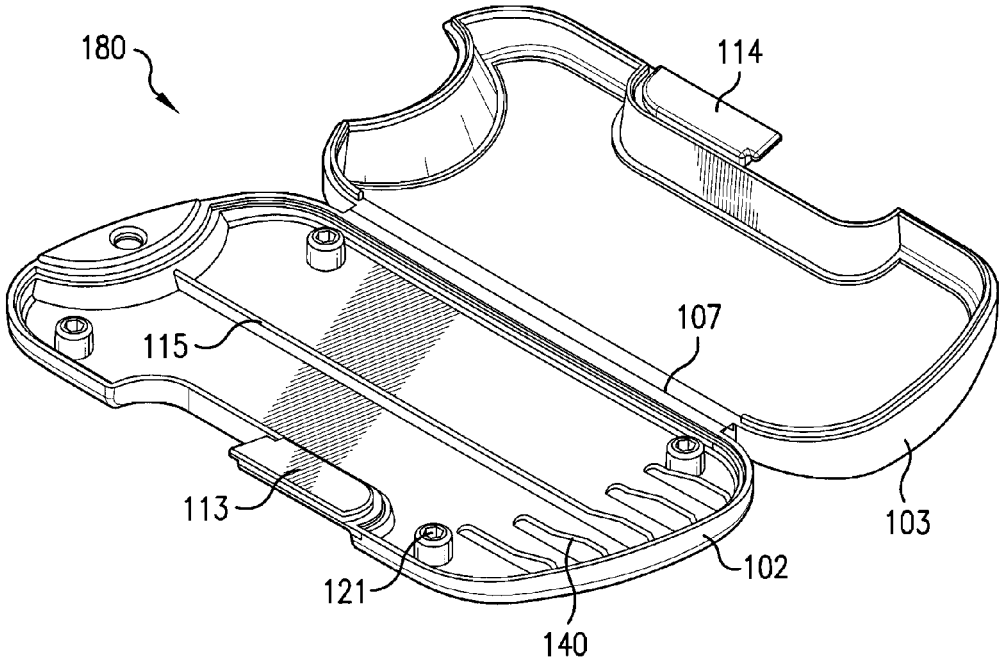

While FIGS. 1 to 5 illustrate an example according to the first example embodiment, FIGS. 6(*a*) to 8 illustrate an example according to a second, alternative example embodiment. The example according to the second embodiment differs from the example of the first embodiment, e.g., in that only a single guide member spans the length of the base. While the first and second embodiments have many features in common, it is noted that the features that differ between the first and second embodiments can be employed in any combination according other example embodiments.

FIGS. 6(*a*) and 6(*b*) depict an isometric top perspective of the components of the second example blister package container according to an alternative example embodiment of the present invention. The blister package container is formed from two injection molded pieces. Referring to FIG. 6(*a*), a flanged element 104 is injection molded as a first single piece, and, referring to FIG. 6(*b*), a base/cover unit 180 is injection molded as a second single piece. The base/cover unit 180 has a base 102, guide members 115 and 140 formed on the base 102, female post members 121 formed on the base 102, a cover 103, a hinge 107 connecting the base 102 and the cover 103, a first latching element 1 13 formed on the base 102, and a second latching member 114 formed on the cover 103. The hinge 107 is preferably formed as a relatively thin, flexible strip of material. In an assembled configuration, the flanged element 104 is attached to the base 102 such that an outer peripheral region of the raised peripheral rim of base 102 remains exposed. This allows the raised peripheral rim of the cover 104 to communicate with the raised peripheral rim of the base 102 when the cover is closed to form a closed container.

The base 102 has a plurality of guide members 115, 140. Guide member 115 is a single rib that extends longitudinally from one end of the base 102 to an opposite end of the base 102. Guide member 115 extends from the bottom of the base 102 to a height that is less than the height of a raised peripheral rim of base 102. Guide member 115 has an upwardly-sloped portion toward a first end of the base 102. This sloped portion extends to a height that is substantially the same as that of the raised peripheral rim of base 102. Additional guide members 140 are parallel to guide member 115 and have similar upwardly-sloped portions. Rather than extending the entire length of the bottom of the base 102, guide members 140 extend a relatively short distance from the first end of the base 102 and terminate with a rounded end. This configuration of guide members 115, 140 allows the bottom of the blister package to sit below the height of the raised peripheral rim of the base 102 when the blister package is inserted into the container. This allows a blister package container that is more compact. Moreover, because only a single guide member 115 extends to the opposite end of the base 102, friction is minimized in order to facilitate insertion and removal of the blister package from the blister package container.

The upwardly-sloped portions of guide members 115, 140 prevent the blister package from catching on the raised peripheral rim of the base 102 when the blister package is removed from the blister package container. As the blister package is slid out of the blister package container, the upwardly-sloped portions guide the blister package to a height at which it will not interfere with the raised peripheral rim. Furthermore, because the bottom, planar portion of blister packages are typically flexible, the edge of the blister package toward the first end of the base 102 can sit at least partially on the upwardly sloped portions when the blister package is in an inserted position. This can allow a container with reduced length. The rounded ends of guide members 140 ensure that the edge or bottom of the blister package does not catch on or is not damaged by a sharp edge. In this regard, the lengths of guide members 140 are preferably selected such that at least a portion of guide members 140 extend beyond the edge of the blister package when the blister package is in an inserted position in the blister package container. This even further limits the possibility of interference between the edge of the blister package and the ends of the guide members 140. The sloped portions of the guide members 115, 140 may provide a further benefit in that they may help deter unwanted slipping of blister package from the case when the cover is being opened and closed.

Figure 7:
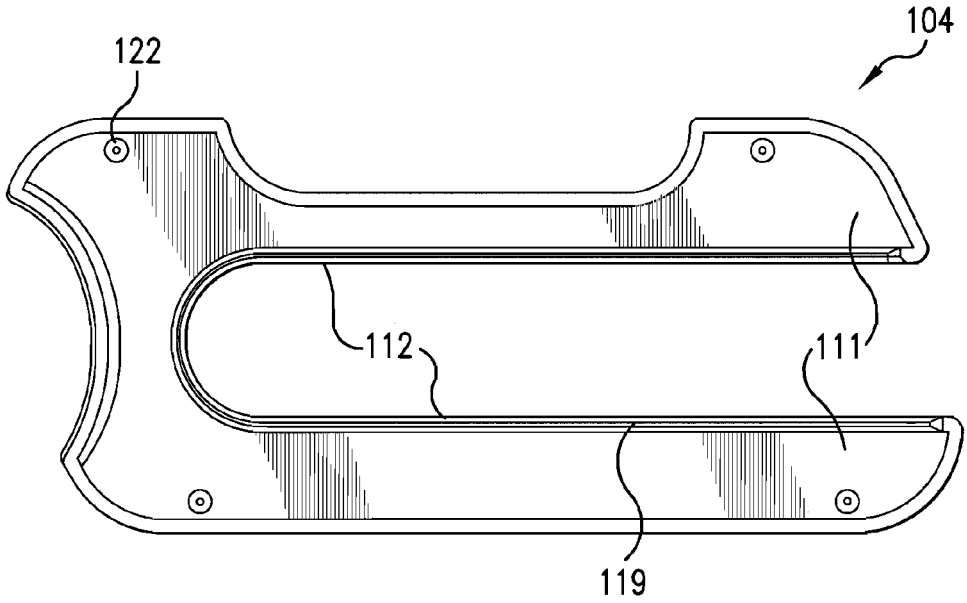
FIG. 7 depicts a bottom view of a flanged element of the second example blister package container, according to the alternative example embodiment of the present invention.
Figure 8:
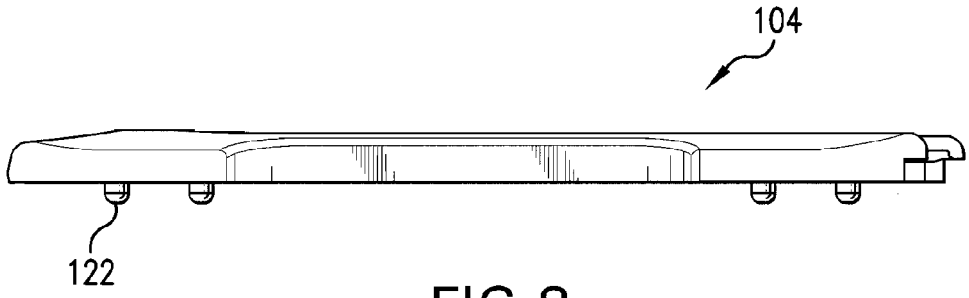
FIG. 8 depicts a side view of a flanged element of the second example blister package container, according to the alternative example embodiment of the present invention.

FIGS. 7 and 8 depict the flanged element 104 of FIG. 6(*a*). Flanged element 104 is injection molded as a single, U-shaped piece with male post members 122 formed integrally therewith. When the blister package container is assembled, male post members 122 mate with the female post members 121 of the base 102 of FIG. 6(*b*). The male post members 122 are attached to post members 121 by an interference fit and/or adhesive. Parallel flanges 111 of flanged element 104 have inwardly-facing surfaces 112 which may communicate with the sides of a blister portion of a blister package as the blister package is inserted and removed from the container. The flanged element 104 also has a lower surface 119 that may communicate with the top surface of a planar portion of a blister package when the blister package is in the inserted positions.

As depicted in FIG. 6(*a*), the flanged element has tapers 151, 152. The lower surface 119, depicted at FIG. 7, follows the pa of the tapers 151 152. The tapers 151, 152 allow a lower surface 114 that ensures smooth insertion and removal of a blister package. As the blister package is inserted into the opening between flanged element 104 and base 102, a leading edge of the blister package initially must be at a position that clears the raised peripheral rim of the base 102. As the leading edge progresses into the container beyond the slope portions of the guide members 115, 140, the taper 152 gradually guides the blister package downward toward the guide member 115, which supports the bottom of the blister package. As the leading edge approaches the opposite end of the container, the taper 151 ensures that the leading edge does not interfere with the rounded portion 155 of the flanged element 104. The lower surface 119, described above in reference to FIG. 7, also balances the blister package on at least a portion of the guide member 115. Flanges 111 have raised portions 120 that, when assembled with base 104, form an opening for the planar portion of the blister package.

Aside from the guide members 140 disposed at the first end of the container, the container supports and guides the blister package along three longitudinal lines of contact. The first is the guide member 115 of the base 102 that contacts the bottom of the blister package directly below the blister portions. The second and third are the regions of lower surface 119 of the flanged element 104 that contact the top of the planar portion of the blister packages on opposite sides of the blister portions. This means of guidance and support allows for substantial variations and irregularities in the planar portion and backing of the blister package. For example, edges that have been deformed during tearing from a blister matrix can be easily accommodated.

While the above described container can be used with blister-packages containing many types of contents, it is particularly well-suited for pharmaceuticals, e.g., antihistamines such as loratidine. It is anticipated that some example embodiments of the container can be distributed empty for retail sale or as a promotion. In addition, some example embodiments of the present invention may include distributing the relevant pharmaceuticals for retail sale or as a promotion together with the containers.

Where the active ingredient is a pharmaceutical agent, representative general classifications of such agents include, for example, adrenergics; adrenocortical steroids; adrenocortical suppressants; aldosterone antagonists; amino acids; anabolics; analeptics; analgesics; anesthetics; anorectics; antiacne agents; antiadrenergics; antiallergics; antiamebics; antianemies; antianginals; antiarthitics; antiasthmatics; antiatherosclerotics; antibacterals; anticholinergics; anticoagulants; anticonvlsants; antidepressants; antidiabetics; antidiarrheals; antidiuretics; antiemetics; antiepileptics; antifibrinolytics; antifungals; antihemorrhagics; antihistarmines; antihyperlipidemics; antihypertensives; antihyotensives; antliufectives; antiinflammatories; antimicrobials; antimigraine; antimitotics; antimycotics, antinauseants, antineoplastics, antineutropenics, antiparasitics; antiproliferatives; antipsychotics; antirheumatics; antiseborrheics; antisecretories; antispasmodics; antithrombotics; antiulceratives; antivirals; appetite suppressants; blood glucose regulators; bone resorption inhibitors; bronchodilators; cardiovascular agents; cholinergics; depressants; diagnostic aids; diuretics; dopaminergic agents; estrogen receptor agonists; fibrinolytics; fluorescent agents; free oxygen radical scavengers; gastrointestinal motility effectors; glucocorticoids; hair growth stimulants; hemostatic agents; histamine $H_2$ receptor antagonists; hormones; hypocholesterolemics; hypoglycemics; hypolipidemics; hypotensives; imaging agents; immunizing agents; immunoomodulators; iluunoregulators; immunostimulants; immunosuppressants; keratolytics; LHRH agonists; mood regulators; mucolytics; mydriatics; nasal decongestants; neuromuscular blocking agents; neuroprotective agents; NMDA antagonists; non-hormonal sterol derivatives; plasminogen activators; platelet activating factor antagonists; platelet aggregation inhibitors; psychotropics; radioactive agents; scabicides; sclerosing agents; sedatives; sedative-hypnotics; selective adenosine Al antagonists; serotonin antagonists, serotonin inhibitors; serotonin receptor antagonists; steroids; thyroid hormones; thyroid inhibitors; thyromimetics; tranquilizers; amyotrophic lateral sclerosis agent; cerebral ischemia agent; Paget's disease agent; unstable angina agent; vasoconstictor; vasodilator; wound healing agent; xanthine oxidase inhibitor; and anti-cancer agents such as taxol and paclitaxel.

Examples of analgesics include codeine, diamorphine, dihydromorphine, ergotamine, fentanyl and morphine; examples of antiallergics include cromoglycic acid and nedocromil; examples of antibiotics include cephalosporins, fusa gin, neomycin, penicillins, pentamidine, streptomycin, sulfonamides and tetracyclines; examples of anticholinergies include atropine, atropine methonitrate, ipratropium bromide, oxitropium bromide and trospium chloride; examples of antihistamines include $H_1$ or $H_2$ antagonists or other types of histamine release inhibitors, the $H_1$ antagonists can be sedating or non-sedating, such as diphenhydramine, chlorheniramine, tripelennamine, promethazine, clemastine, doxylamine, astemizole, terfenadine, loratadine and desloratadine, among others, the $H_2$ antagonists include, but are not limited to, cimetadine, famotidine, nizatidine, and ranitidine; examples of histamine-release-inhibitors include, but are not limited to, cromolyn; examples of antiinflammatory substances include beclomethasone, budesonide, dexamethasone, flunisolide, fluticasone, tipredane and triameinolone; examples of antitussives include narcotine and noscapine; examples of bronchodilators include bambuterol, bitolterol, carbuterol, clenbuterol, ephedrine, epinephrine formoterol, fenoterol, hexoprenaline, ibuterol, isoprenaline, isoproterenol, metaproterenol, orciprenaline, phenylephrine, pseudoephedrine, phenylpropanolamine, pirbuterol, procaterol, reproterol, rimiterol, salbutamol, salmeterol, sulfonterol, terbutalin and tolobuterol; examples of diuretics include amiloride and furosemide; examples of enzymes include amylase, lipase, protease and trypsin; examples of cardiovascular substances include diltiazem and nitroglycerine; examples of hormones include cortisone, hydrocortisone, prednisolone cyproterone acetate, norethisterone acetate, progesterone, 3-keto-desogestrel, norgestimate, laevonorgestrel, desogestrel, gestodene, estrogen, δ-4-androstenedione, testosterone, dihydrotestosterone, or androstanolone, examples of proteins and peptides include cyclosporins, cetrorelix, glucagon and insulin.

Particularly for pharmaceuticals that have a bad taste, they may be packaged in a coated or capsule form to allow them to be ingested while masking the taste. In some of these forms, if the coated or capsule forms are damaged, e.g. by rough handling in purse or pocket, the masking of the taste would be lessened or eliminated. Accordingly, the example container allows easy transport of such pharmaceuticals while minimizing the likelihood of such damage.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. A container for a blister package, comprising:

a base having an interior surface, a plurality of parallel longitudinal ribs disposed on the interior surface and in communication with a first region of a periphery of the base, the ribs being upwardly sloped toward the first region, at least one of the plurality of ribs having a non-sloped portion that substantially spans the length of the interior surface toward a second region of the periphery, and a first latching element;

a cover attached to the base by a hinge, the cover having a second latching element, the second latching element latchably engageable with the first latching element when the cover is in a closed position; and a U-shaped flanged element disposed between the base and the cover when the cover is in the closed position, the U-shaped flanged element attached to the base via post connectors.

2. An article of manufacture, comprising the container of claim 1 and a pharmaceutical compound in solid dosage form contained in a blister package, the blister package situated between the base and the U-shaped flanged element.

3. The container of claim 1, wherein the flanged element is attached to the base by plurality of post connectors.

4. The container of claim 3, wherein each post connector comprises a male post on one of the base and the flanged element and a female post on the other of the base and the flanged element.

5. The container of claim 3, wherein the post connectors are bonded with adhesive.

6. The container of claim 1, wherein the flanged element has at least one taper, the at least one taper configured to prevent a leading edge of the blister package from interfering with the flanged element.

* * * * *